US010062978B2

(12) United States Patent
Henke et al.

(10) Patent No.: US 10,062,978 B2
(45) Date of Patent: Aug. 28, 2018

(54) ELECTRICAL CONNECTOR ASSEMBLY

(71) Applicant: Weidmüller Interface GmbH & Co. KG, Detmold (DE)

(72) Inventors: Ralf Henke, Brühl (DE); Torsten Diekmann, Leopoldshöhe (DE); Jörg Diekmann, Oerlinghausen (DE); Jan Meier, Detmold (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/128,601

(22) PCT Filed: Mar. 18, 2015

(86) PCT No.: PCT/EP2015/055633
§ 371 (c)(1),
(2) Date: Sep. 23, 2016

(87) PCT Pub. No.: WO2015/150075
PCT Pub. Date: Oct. 8, 2015

(65) Prior Publication Data

US 2017/0110811 A1 Apr. 20, 2017

(30) Foreign Application Priority Data

Apr. 3, 2014 (DE) ..... 20 2014 101 581

(51) Int. Cl.
*H01R 9/22* (2006.01)
*H01R 9/24* (2006.01)
*H01R 24/68* (2011.01)

(52) U.S. Cl.
CPC ..... *H01R 9/2458* (2013.01); *H01R 24/68* (2013.01)

(58) Field of Classification Search
CPC ..... H01R 9/24; H01R 9/2491; H01R 9/2416; H01R 9/26; H01R 9/2608; H01R 4/36;
(Continued)

(56) References Cited

U.S. PATENT DOCUMENTS 3,327,174 A * 6/1967 Barre ..... H01R 13/665 361/744
3,660,728 A * 5/1972 Carter ..... H01R 23/68 361/789
(Continued)

FOREIGN PATENT DOCUMENTS

DE 29606007 U1 6/1996
DE 10216159 A1 7/2003
(Continued)

*Primary Examiner* — Hien Vu
(74) *Attorney, Agent, or Firm* — Laubscher, Spendlove & Laubscher, P.C.

(57) ABSTRACT

The invention relates to a terminal assembly and in particular a series terminal assembly for medium-voltage switchgears. The assembly includes at least two input-side connectors and at least two output-side connectors in addition to a configuration location. The input-side connectors and the output-side connectors are not interconnected in a fixed pre-configured manner. Each of the configuration locations for each input-side connector location and for each output-side connector location has a configuration connector location.

7 Claims, 12 Drawing Sheets

(58) Field of Classification Search
CPC ..... H01R 4/34; H01R 29/00; H01R 13/629; H01R 13/193
USPC ..... 439/716, 94, 49, 341, 713, 715
See application file for complete search history.

(56) References Cited

U.S. PATENT DOCUMENTS

| | | | | |
|---|---|---|---|---|
| 3,950,058 | A * | 4/1976 | Cronin | H02G 15/10 439/189 |
| 2007/0066123 | A1* | 3/2007 | Arlitt | H01R 4/24 439/409 |
| 2009/0203234 | A1* | 8/2009 | Heggemann | H01R 9/2625 439/59 |
| 2013/0010395 | A1 | 1/2013 | Birkholz et al. | |

FOREIGN PATENT DOCUMENTS

| | | | |
|---|---|---|---|
| DE | 202005003820 | U1 | 5/2005 |
| DE | 102010012684 | A1 | 9/2011 |
| EP | 2626879 | A1 | 8/2013 |

* cited by examiner

ELECTRICAL CONNECTOR ASSEMBLY

This application is a § 371 National Stage of PCT International Application No. PCT/EP2015/055633 filed Mar. 18, 2015. PCT/EP2015/055633 claims priority to DE20 2014 101 581.7 filed Apr. 3, 2014. The entire contents of these applications are incorporated herein by reference.

BACKGROUND OF THE INVENTION

The invention concerns an electrical connector assembly for the connecting of two electrical functional components.

For power transmission and distribution, control devices are required for low, medium, or high voltage switchgears. The control device, besides providing control functions, also takes on monitoring, protection, and/or measuring functions. For this, various electrical components are connected to each other, such as protective or auxiliary relays, electrical and/or mechanical switches, push buttons, pilot lights and/or measuring and/or indicating instruments for current, voltage, power and/or frequency. In order to assure their functionality, such switchgears need to be configured. Because of the many different functions required, the wiring expense may sometimes be substantial.

For easier and quicker connections, series terminal assemblies are used in which input-side connectors for connecting electrical plugs or conductors to output-side connectors are joined together via bus bars. The bus bars can be interconnected via plug-in cross bridges arranged in the direction of the series terminals or within a series terminal, in order to connect the input-side connectors to the output-side connectors.

BRIEF DESCRIPTION OF THE PRIOR ART

DE 20 2008 013 610 U1 discloses such a series terminal assembly. In this series terminal assembly, an input-side connector is connected to an output-side connector via a bus bar. Furthermore, it is possible to interconnect leads via connectors, including via mutually perpendicular oriented connectors of various kinds. Also disclosed is a configuration in which a plug unit which is configurable with connectors is mounted on the series terminal assembly in order to appropriately connect the input and output-side leads. But for this reason the assembly does not allow the input-side connectors to be connected together, without at the same time interconnecting the output-side connectors connected to the input-side connectors via the bus bar. Also, it is therefore not possible to interconnect the output-side connectors without at the same time interconnecting the input-side connectors which are connected to the output-side connectors via the bus bar. Accordingly, the invention starts from the premise that the possible connection variants are needlessly restricted.

The problem which the present invention proposes to solve is to create an easily manipulated electrical connector assembly which eliminates these drawbacks, and which therefore makes it possible to interconnect the input-side connectors without thereby also connecting the output-side connectors, and vice versa.

SUMMARY OF THE INVENTION

The problem is solved with a connector assembly, especially a series terminal assembly, especially for a medium-voltage switchgear, which includes at least two input-side connectors and at least two output-side connectors, between which a configuration location is provided, wherein the input-side connectors and the output-side connectors are not preconfigured and permanently interconnected via conductors or other bus bars of the connector assembly.

The connector assembly is characterized in that the input-side connectors and the output-side connectors are not electrically interconnected. Furthermore, the configuration location for each input-side connector and for each output-side connector comprises a configurable connector.

In this way, it is possible to interconnect individual input-side connectors without at the same time also connecting output-side connectors. Furthermore, it is possible to interconnect individual output-side connectors without at the same time also connecting input-side connectors.

It is preferable to arrange the configurable connector between the input-side connectors and the output-side connectors and/or above the input-side connectors and the output-side connectors. In this way, it is easily accessible from the outside.

In order to electrically interconnect the input-side and output-side connectors in the desired configuration by electrically connecting their associated connectors, it is preferred in a first embodiment to use a traditional connecting kit, such as is disclosed for example in DE 20 2008 013 610 U1. Such a connecting kit enables electrical connecting of configurable connectors both in a lengthwise direction and in a transverse direction through the use of cross connectors.

In another preferred embodiment, the configurable connectors are designed as plug and/or socket connections, especially as spring-loaded terminals. In this embodiment, they are designed for connecting electrical sockets or plugs, and/or for connecting of electrical conductors.

Furthermore, a preferred embodiment includes a connecting kit for the electrical connection of the configurable connectors, and which includes for each configurable connector a plug and/or a socket connection. In such a connecting kit, the configurable connectors are preferably interconnected by electrical conductors.

The use of a separate connecting kit has the advantage that this can be configured separately from the input-side connectors and separately from the output-side connectors.

Furthermore, it is preferred that the input-side and/or output-side connectors also be designed as such plug and/or socket connections.

In a first preferred embodiment, the input-side and the output-side connectors as well as the configurable connectors are arranged on a single overall terminal block.

Yet another embodiment is especially preferred, in which the input-side connectors and their associated configurable connectors are arranged on a first input terminal block, and in which the output-side connectors and their associated configurable connectors are arranged on a second output terminal block. It is preferable that the input terminal block and the output terminal block be separable from each other. In this way, they can be configured separately and independently of each other.

Or they are provided to be displaceable, rotatable, or swivelable at least relative to each other, so that the input-side connectors, the output-side connectors and the configurable connectors are very easily accessible from the outside, at least during the configuration.

The input terminal block and the output terminal block are preferably identical in design, in order to keep the number of different parts needed for the connector assembly as small as possible.

It is moreover advantageous and simple for the configurable connectors to be designed as plug and socket connectors at the input and output sides and for the mating configurable connectors corresponding to the configurable connectors to be designed as corresponding plug and socket connectors. Further, it is advantageous and simple for the mating configurable connectors and the corresponding plug and socket connectors to be interconnected by means of wires, bus bars, jumpers, or by at least one circuit board provided with conductor tracks.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1A:
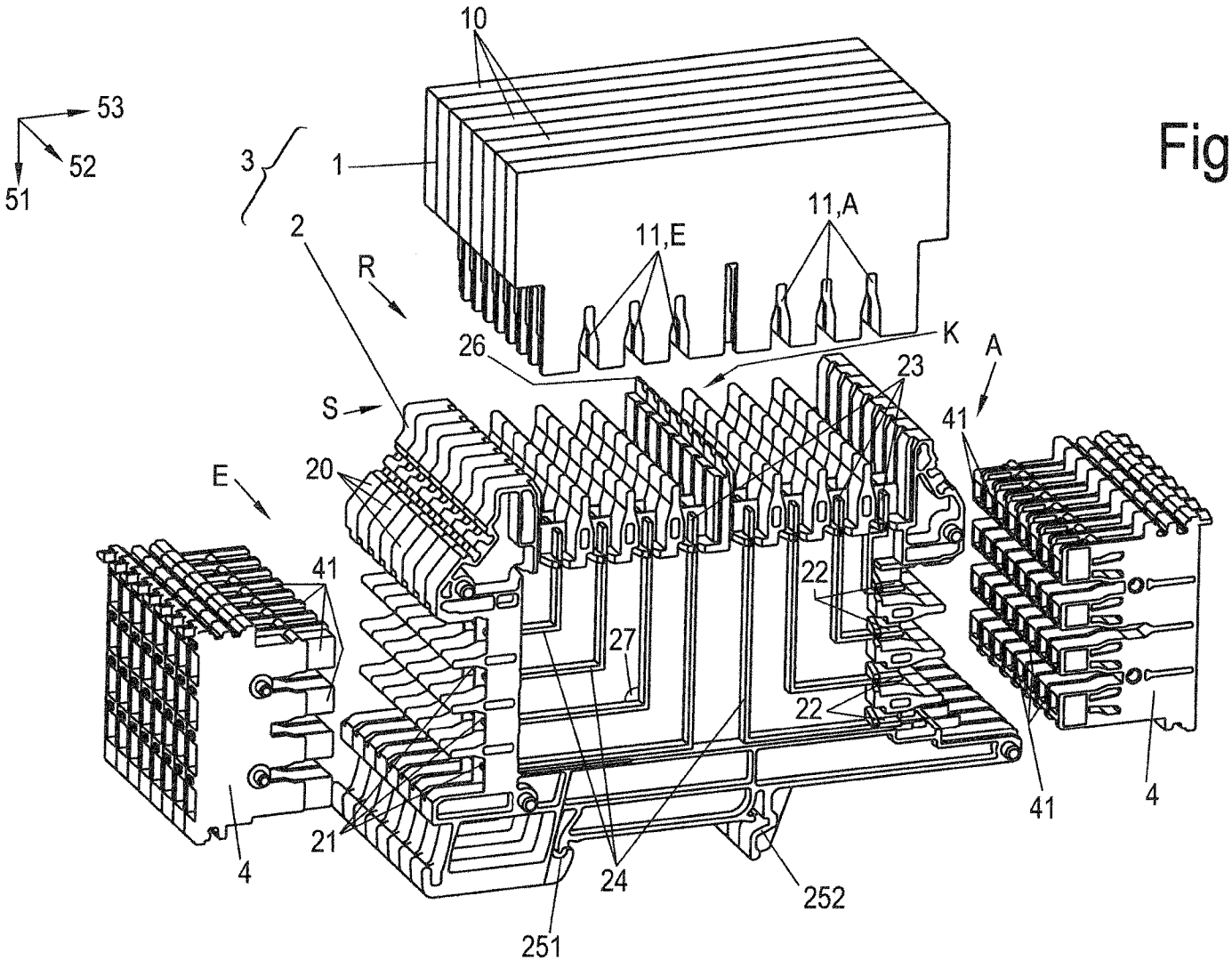
FIG. 1*a* is an exploded perspective view of a first embodiment of a connector assembly according to the invention.
Figure 1B:
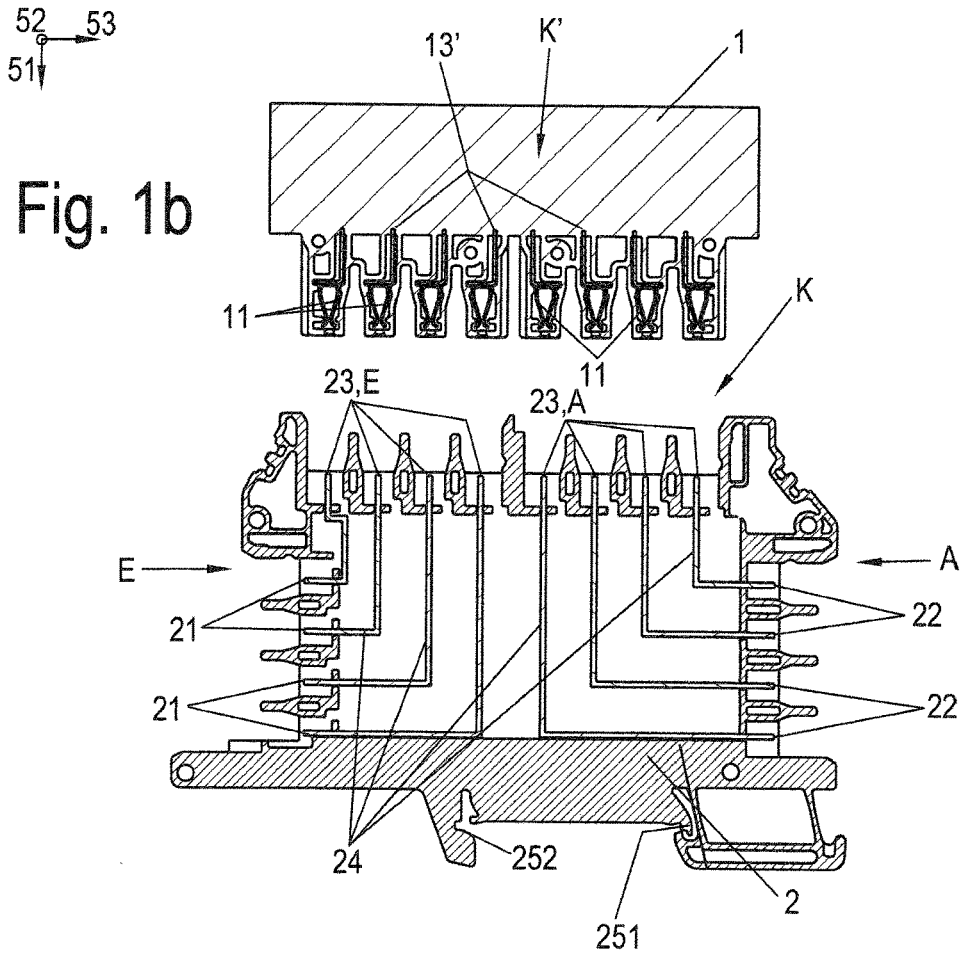
FIG. 1*b* is an exploded front plan view of a portion of the assembly of FIG. 1*a;*
Figure 1C:
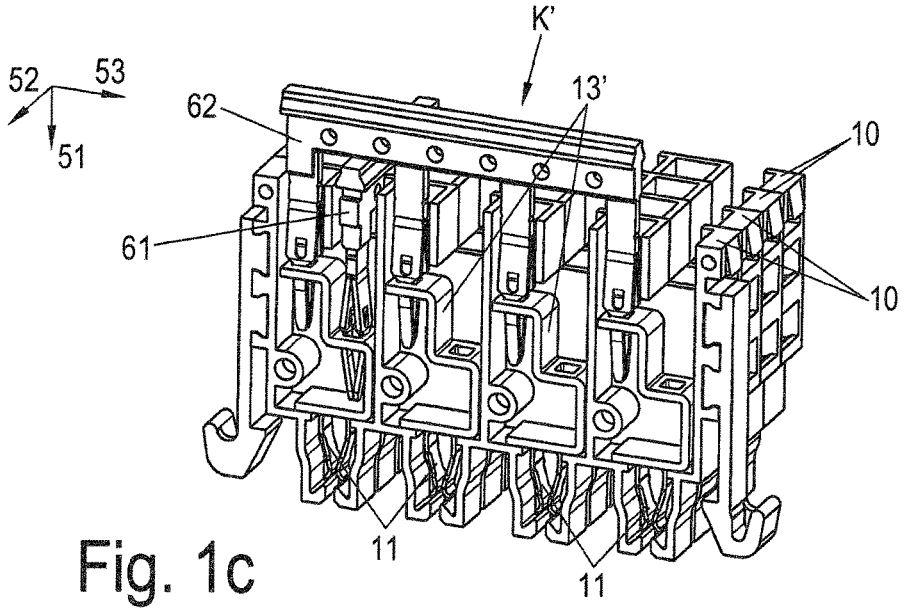
FIG. 1*c* is perspective view of a portion of the assembly of FIG. 1*a;*
Figure 2A:
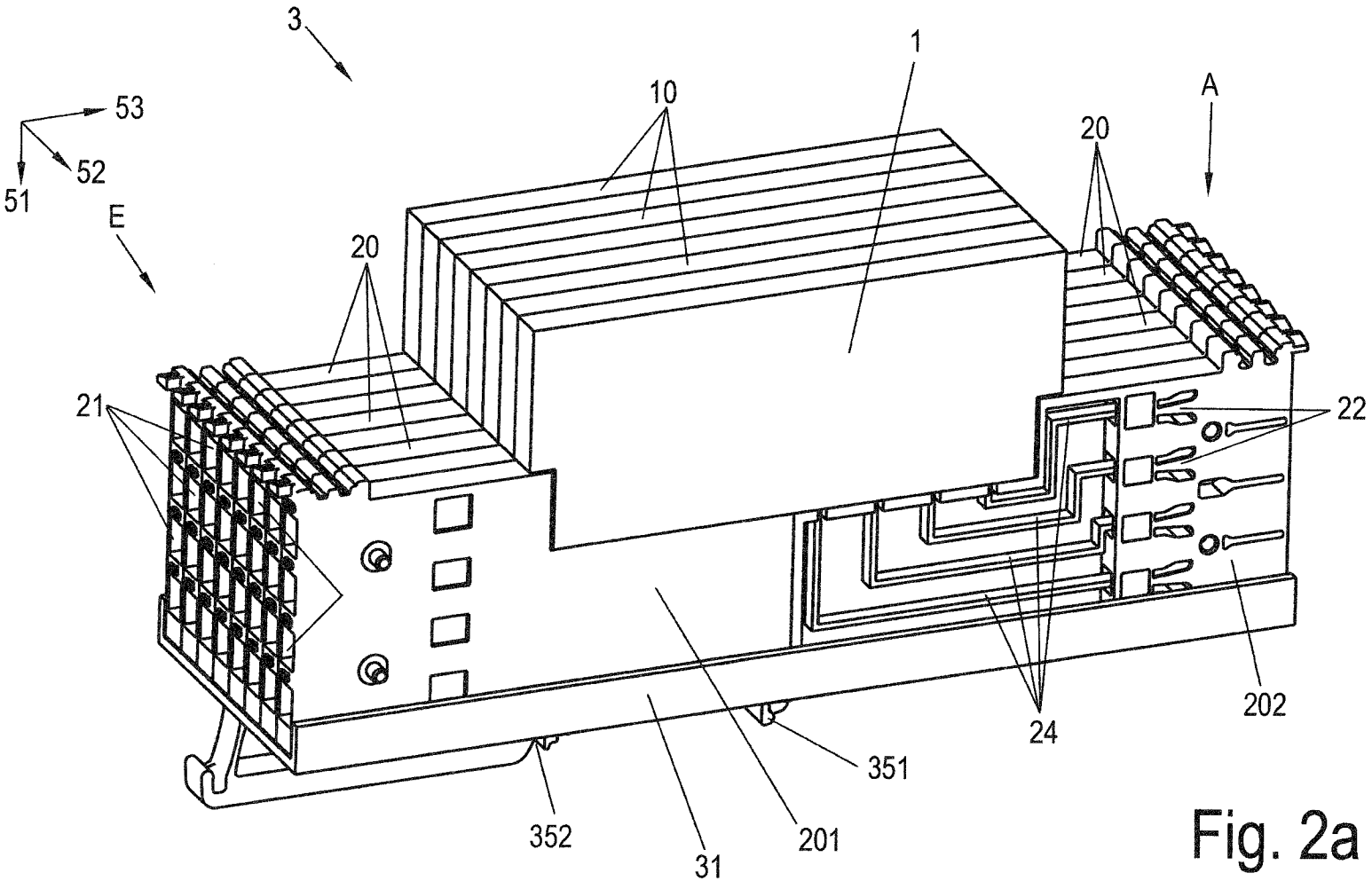
FIG. 2*a* is a perspective view of a second embodiment of a connector assembly according to the invention.
Figure 2B:
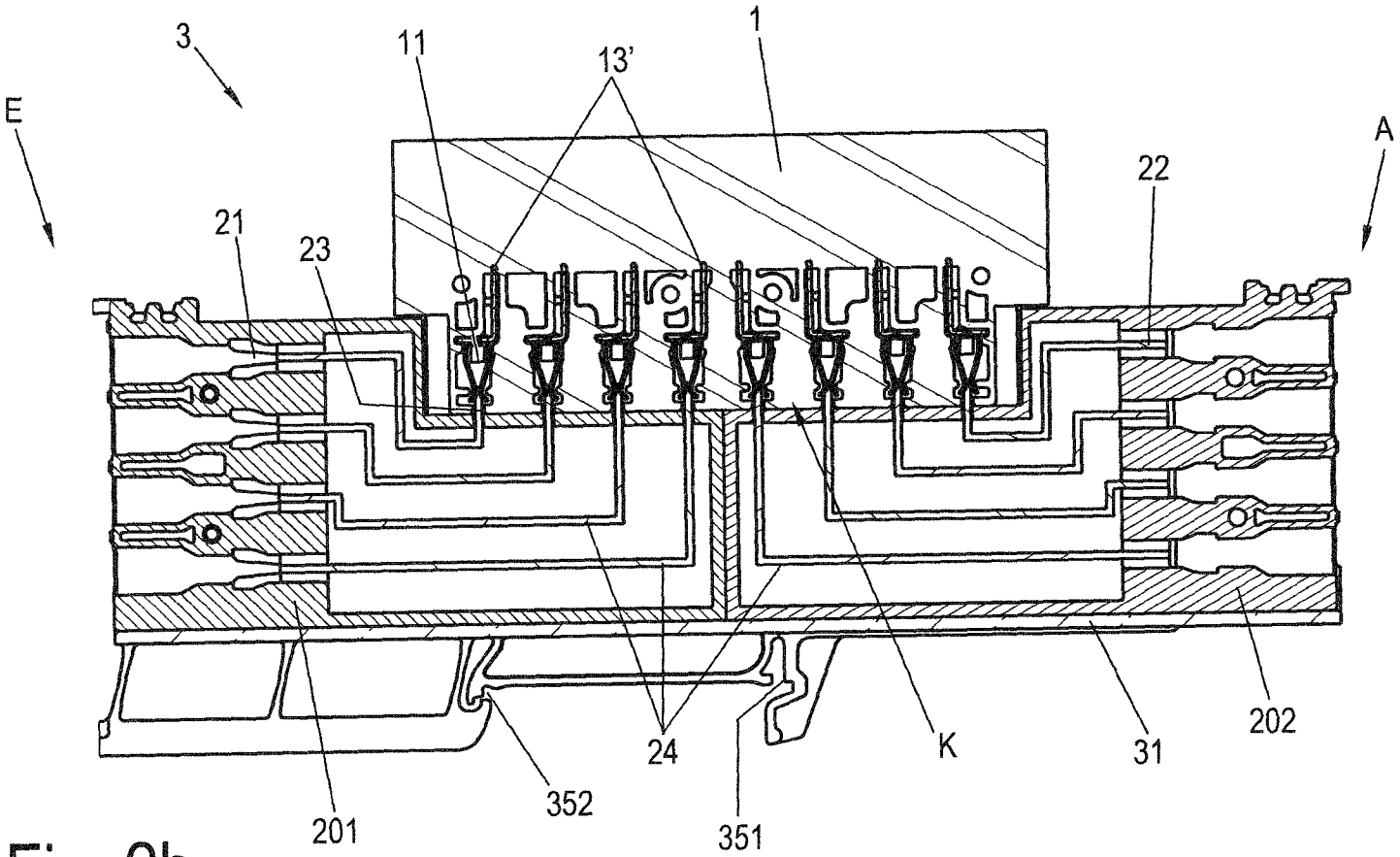
FIG. 2*b* is a sectional view of the assembly of FIG. 2*a;*
Figure 2C:
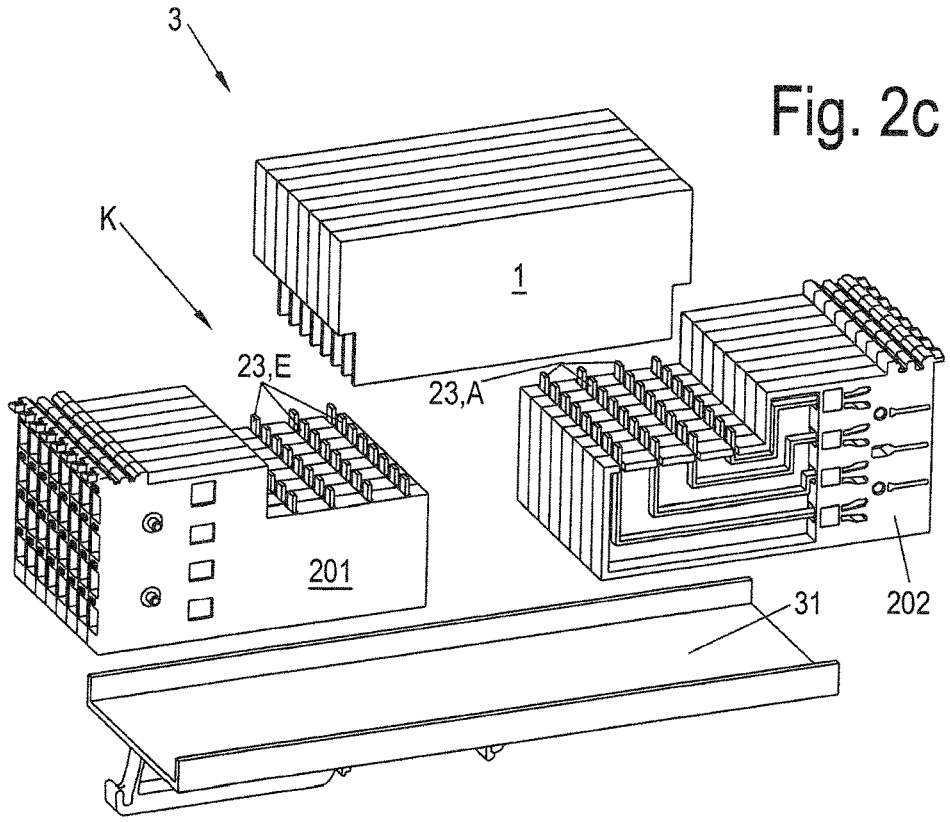
FIG. 2*c* is an exploded top perspective view of the assembly of FIG. 2*a;*
Figure 2D:
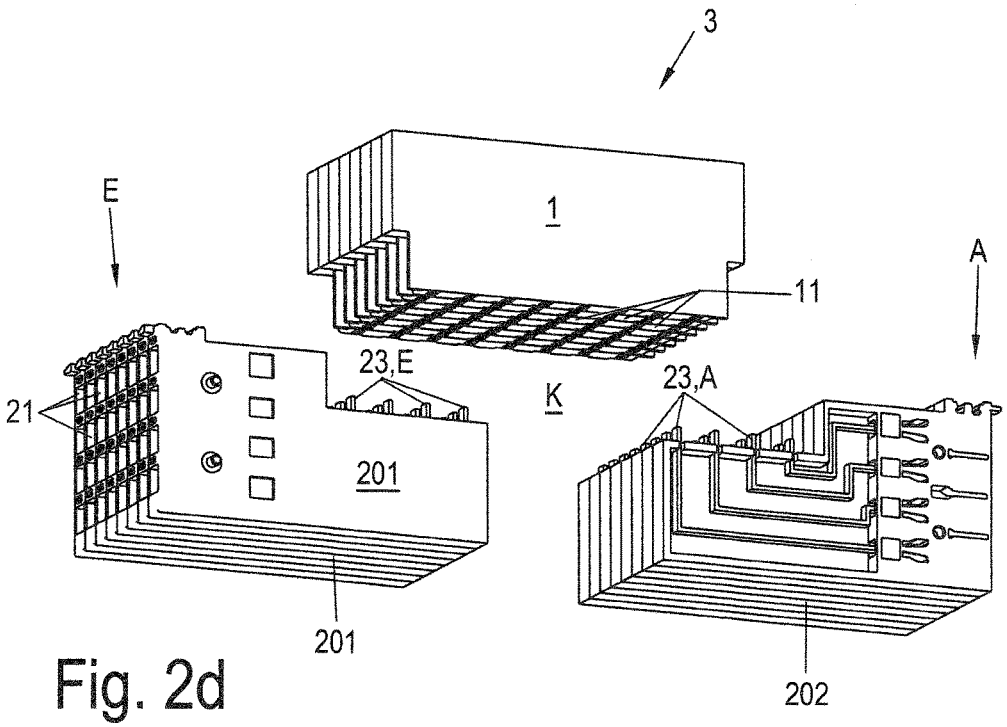
FIG. 2*d* is an exploded bottom perspective view of a portion of the assembly of FIG. 2*a;*
Figure 3A:
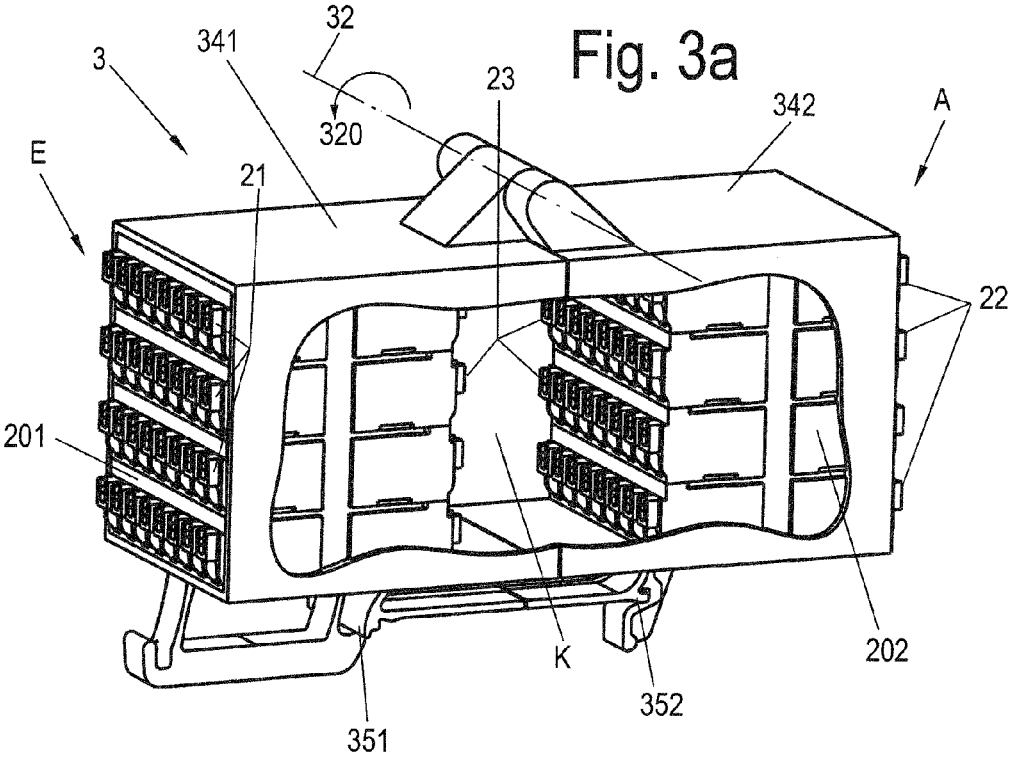
FIGS. 3*a* and 3*b* are partial cutaway and perspective views, respectively, of a connector assembly according to a third embodiment of the invention.
Figure 3B:
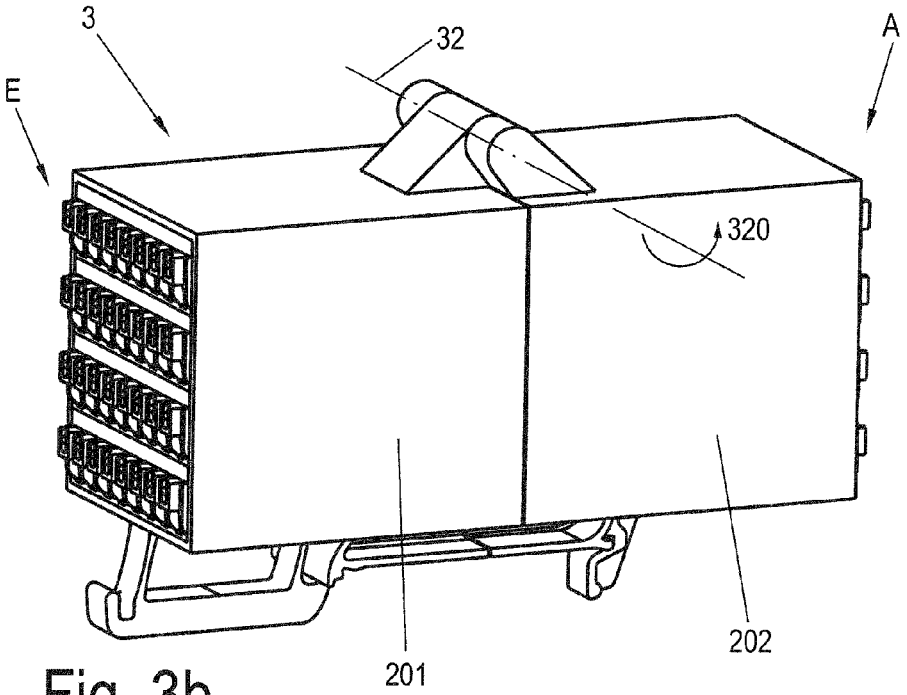
Figure 3C:
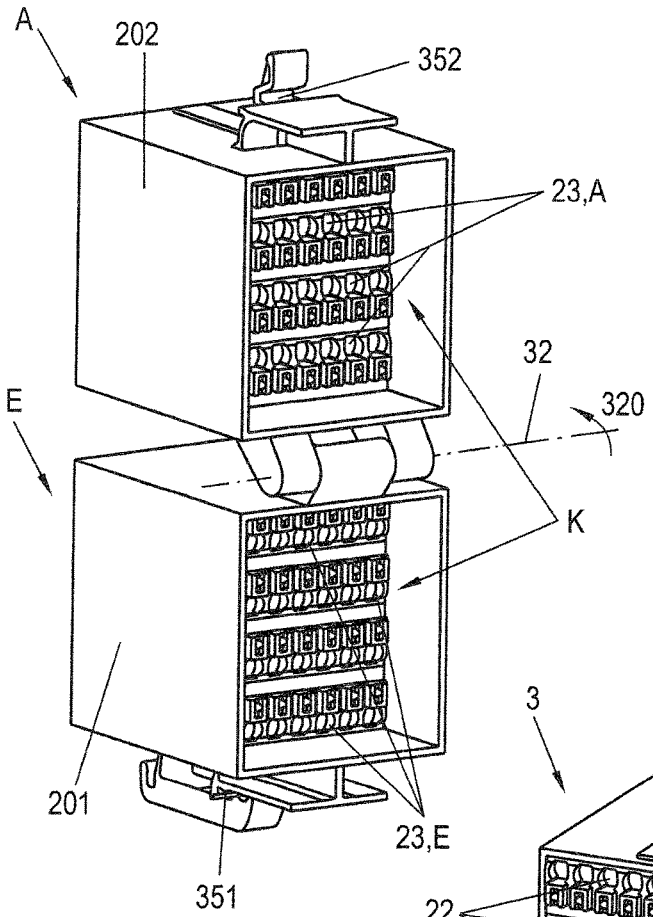
FIGS. 3*c* and 3*d* are front and rear perspective views, respectively of the assembly of FIGS. 3*a* and 3*b* in an open configuration.
Figure 3D:
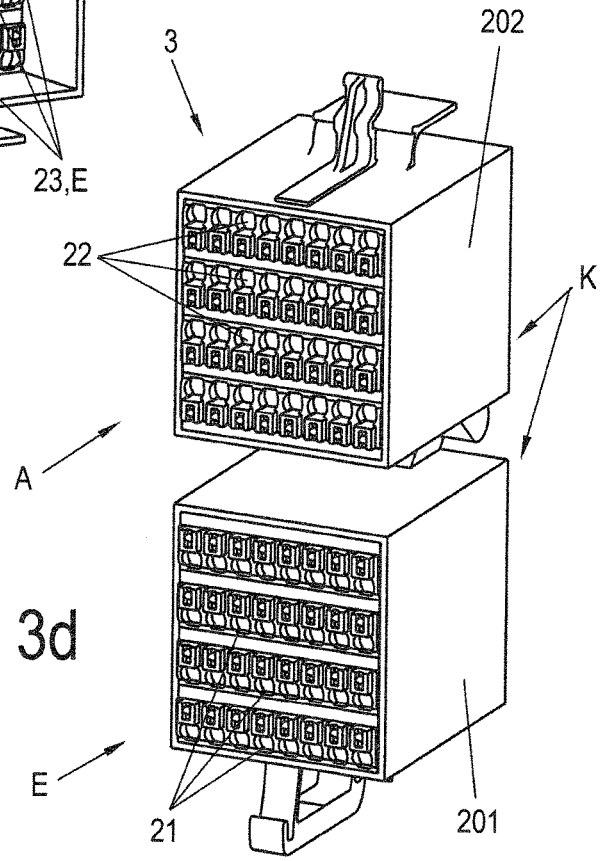
Figure 3E:
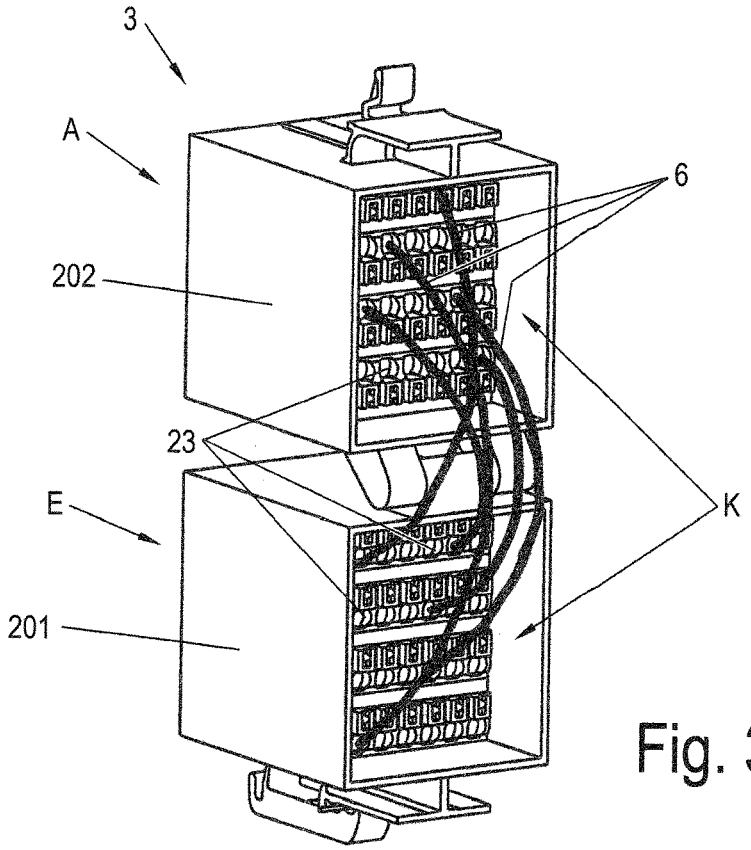
FIGS. 3*e* and 3*f* are front perspective and cutaway views, respectively, corresponding with FIGS. 3*c* and 3*a* of the assembly and illustrating conductors for the assembly.
Figure 3F:
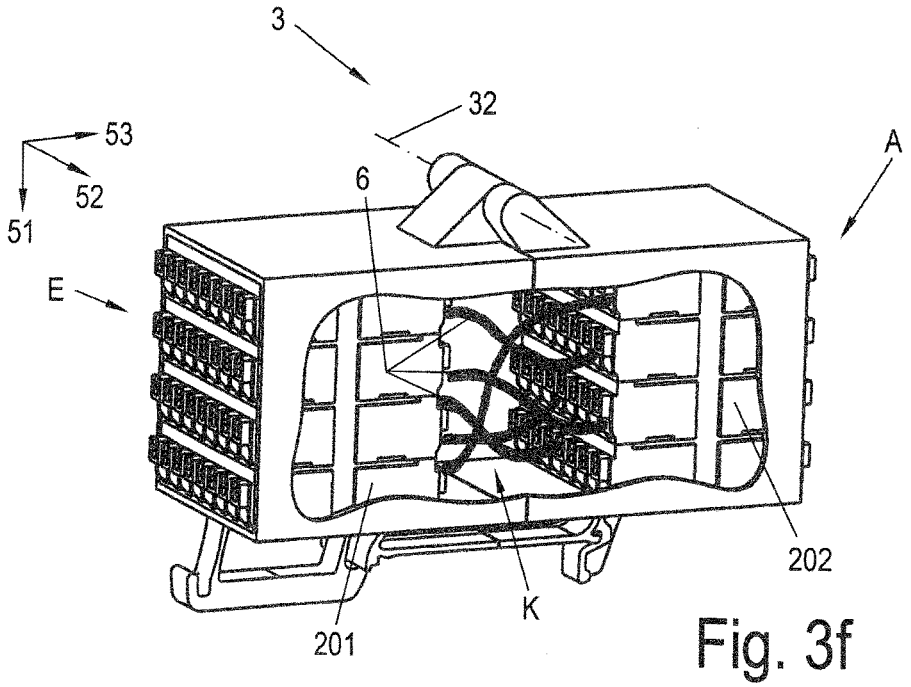
Figure 4A:
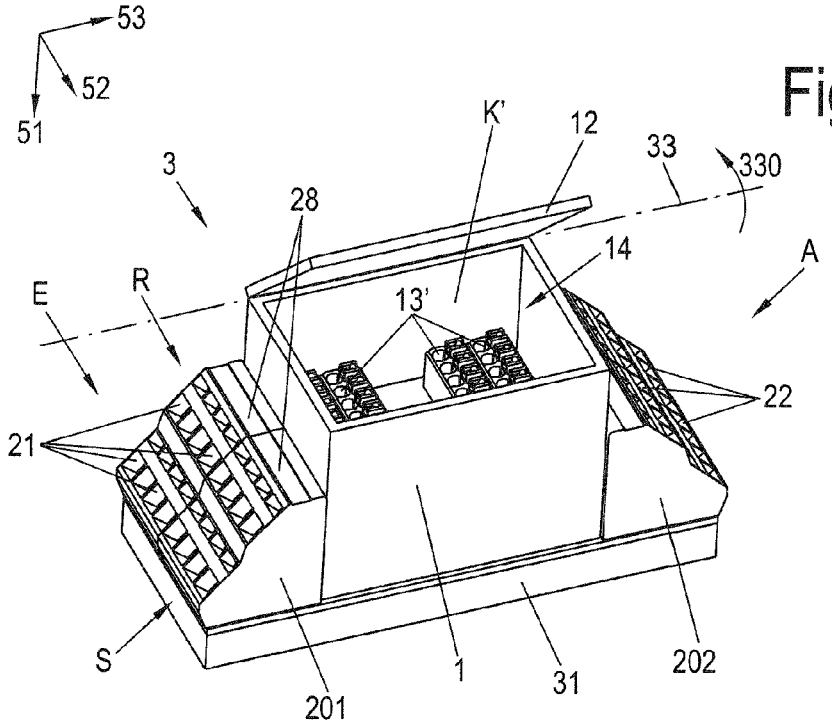
FIGS. 4*a* and 4*b* are top perspective views of a connector assembly according to a fourth embodiment in open and closed conditions, respectively.
Figure 4B:
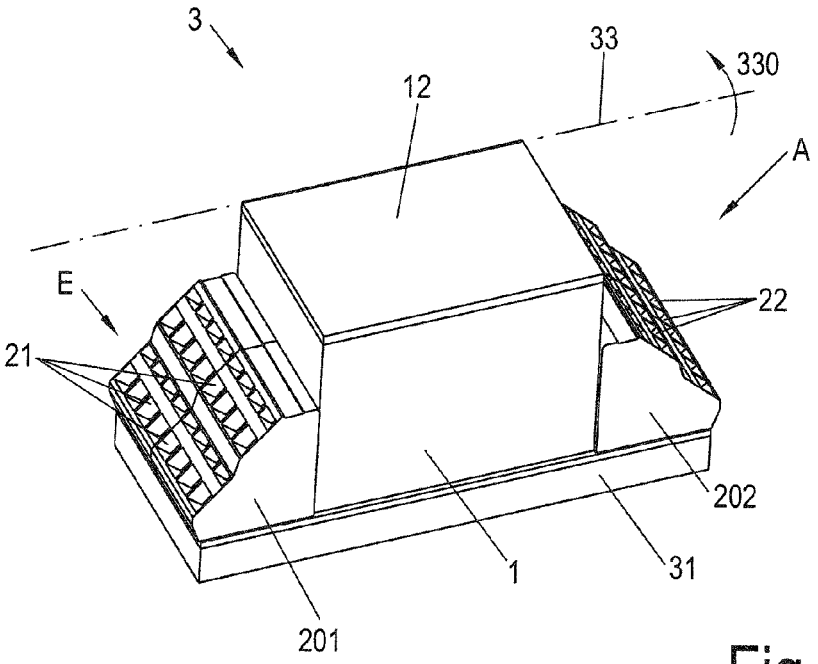
Figure 4C:
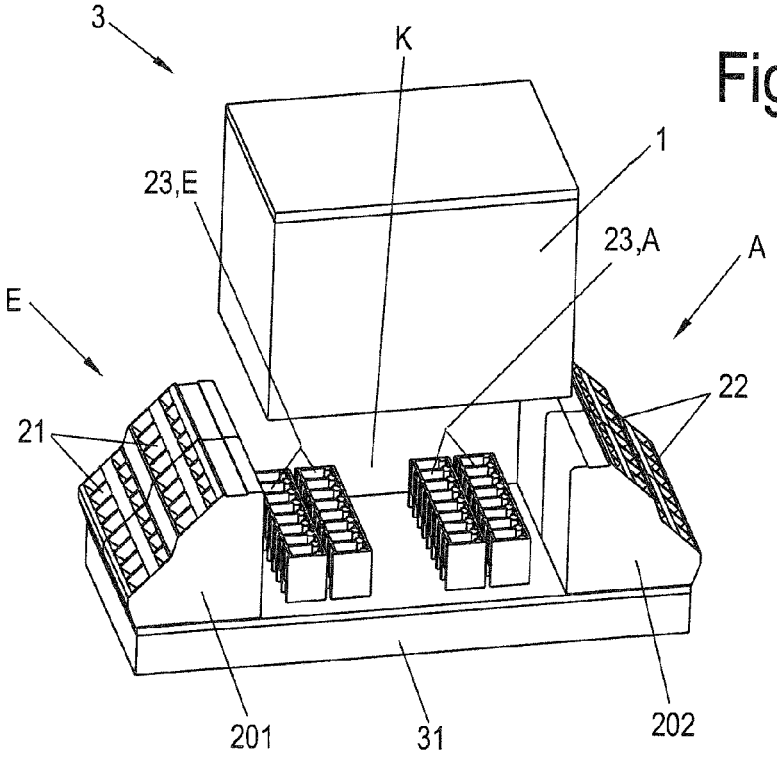
FIGS. 4*c* and 4*d* are top and bottom exploded perspective views, respectively, of the assembly of FIGS. 4*a* and 4*b;*
Figure 4D:
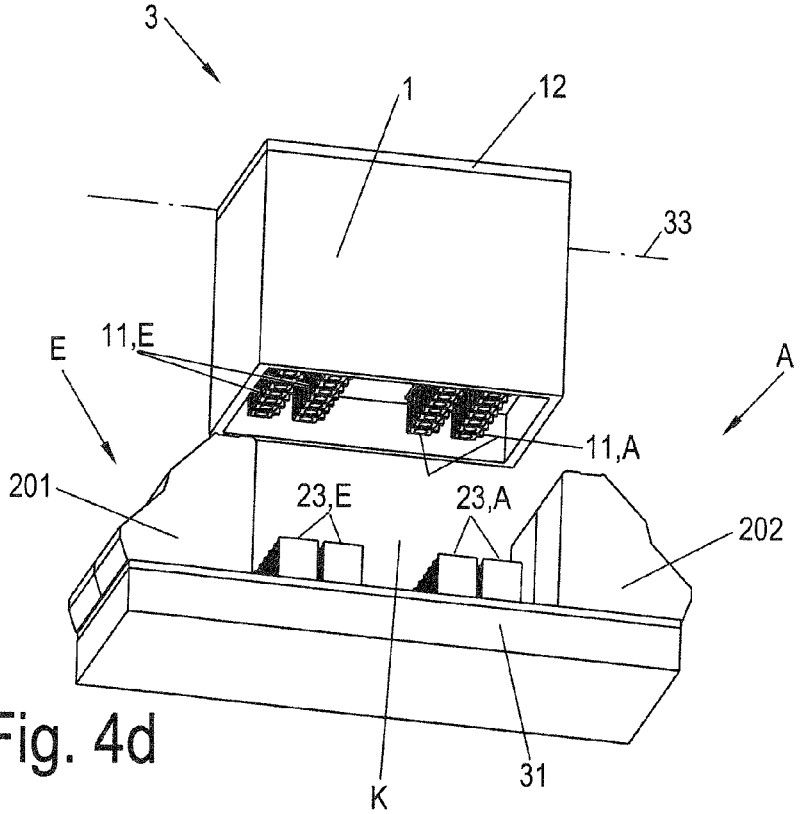
Figure 4E:
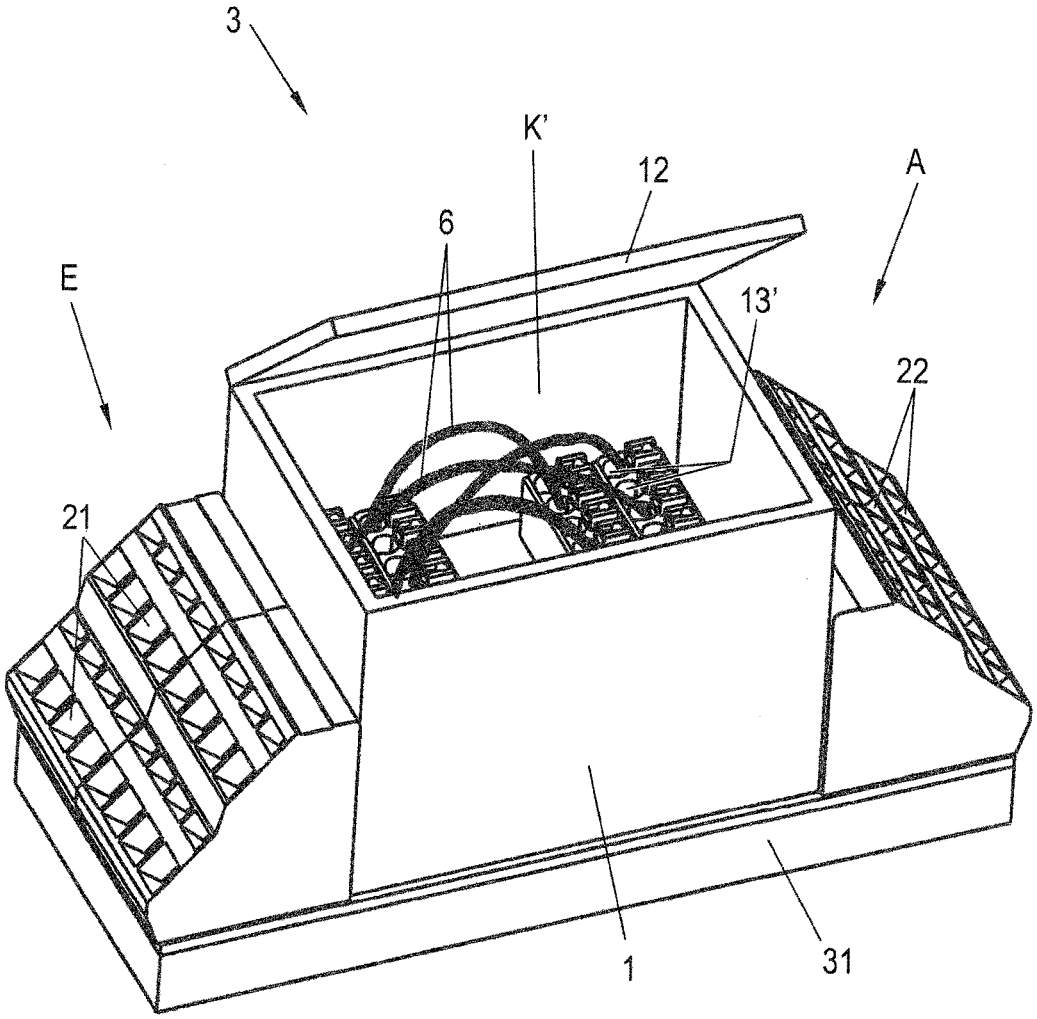
FIG. 4*e* is a top perspective view corresponding with FIG. 4*a* and illustrating conductors for the assembly.

FIGS. 1*a-d* illustrate a first embodiment of the connector assembly 3, namely, in a perspective view (a), in a cross section through the connector assembly 3 (b) and a traditional connecting kit 1 for the connector assembly 3 (c).

This connector assembly 3 is a series terminal assembly with a plurality of series terminals 20 placed alongside each other in an arrangement direction 52, and therefore in a row. Eight series terminals are shown, but any number may be provided. The series terminals 20 preferably each have locking devices 251, 252 for mounting on a support rail (not shown).

Each of the series terminals 20 includes a plurality (in this example four) of input-side connectors 21 and output-side connectors 22. The connectors 21, 22 are arranged one on top of another in the vertical direction 51, i.e., in a column. At the input and output side, the connector assembly 3 therefore includes a patch field with 4*8 connectors 21, 22.

The connectors 21, 22 are designed as plug-in units. But a design as socket units is also possible.

Each input-side connector location 21 and each output-side connector location 22 is electrically connected by a bus bar 24 to a connector 23 which may be a configurable connector. The bus bars 24 have no preconfigured electrical connection, such as by bus bars or the like.

The connectors 23 are arranged on a configuration location K. They are grouped into rows R and columns S. In the embodiment shown, the connectors 23 on the input side E connected to the input-side connectors 21 and the connectors 23 on the output side A connected to the output-side connectors 22 are spatially separated from each other by a housing 26, especially an electrically insulating housing.

The connectors 23 are also designed as plugs, while a socket design is preferred.

The connectors 23 are arranged in the vertical direction 51 above and between the input-side and output-side connectors 21, 22. The bus bars 24 make an angle 27 to each other, here a right angle. The connectors 23 are thereby easily accessible to the user from above, and the input-side and output-side connectors 21, 22 are accessible from opposite sides in an extension direction 53 of the connector assembly 3.

The connectors 23, the input-side connectors 21 and the output-side connectors 22 are arranged on a terminal block 2. This is formed from the series terminals 20 arranged in rows. Therefore, by arranging rows of more or fewer series terminals 20, the overall terminal block 2 can be adapted to the required number of connectors 21, 22, 23.

In the sample embodiment shown, a plug and/or socket connection 4 for a wiring harness (not shown) is shown at the input side E and at the output side A, for example, which can be attached to the input-side or output-side connectors 21, 22. The plug and/or socket connections 4 include sockets, especially push-in connections, as a mating connector location 41 for pushing onto the plugs of the connectors 21, 22. In this embodiment, a wiring harness plug and/or socket connection 4, especially a ready assembled connection, can be easily attached at the input or output side to the overall terminal block 2. The plug and/or socket connections 4 of the wiring harness can therefore be configured/assembled independently of the connector assembly 3.

For the electrical connection of the input-side connectors 21 to the output-side connectors 22 there is shown a connecting kit 1. The connecting kit 1 is also formed from a plurality of row caps 10 arranged in a row. It can likewise be adapted to the required number of connectors 21, 22, 23 by having more or fewer row caps 10 arranged in a row.

The connecting kit 1 includes, for each connector 23 of the overall terminal block 2, a mating connector 11.

The mating connectors 11 are designed as sockets, especially as push-in connectors. They can therefore be attached by simple pushing onto the plug units of the connectors 23, especially from above.

The mating connectors 11 can be flexibly interconnected in the connecting kit 1 independently of the connector assembly 3 and in regard to the possible plug and socket connections. For this, each mating connector 11 includes a connecting plug 13'. The connecting plugs 13' of the connecting kit 1 shown in FIG. 1(*b*) are designed as plug units, with those of the connecting kit 1 shown in FIG. 1(*c*) as socket units. The connecting kit 1 therefore includes a second configuration location K' designed to correspond to the configuration location K. At the second configuration location K', a connecting plug 13' is provided for each mating connector 11.

For the electrical connection of the connecting plugs 13', FIG. 1(*c*) shows a first cross connector 62 which interconnects a plurality of connecting plugs 13' of the same column S. The first cross connector 62 inserted in the connecting plugs 13' therefore extends in the extension direction 53 of the connector assembly 3. In this way, it interconnects a plurality of input-side and/or output-side connectors 21, 22 of the same series terminal 20.

Furthermore, FIG. 1(*c*) shows a second cross connector 61 which extends in the arrangement direction 52. The second cross connector 61 therefore interconnects a plurality of connecting plug locations 13' of the same row R. In this way, it interconnects a plurality of input-side or a plurality of output-side connectors 21, 22 of different series terminals 20.

In the embodiment of the connector assembly 3 shown in FIGS. 2*a-d*, the input-side connectors 21 and the connectors 23 electrically connected to them, especially by the bus bars 24, are arranged in a first terminal block 201. Furthermore, the output-side connectors 22 and the connectors 23 electrically connected to them, especially across the bus bars 24, are arranged in a second terminal block 202. The terminal blocks 201, 202 are completely separable from each other. They can therefore be assembled or configured independently.

Instead of first assembling a wiring harness plug and/or socket connection 4 (see FIG. 1(*a*)) and then connecting it to an overall terminal block 2, the embodiment shown in FIG. 2 makes a direct connection of a wiring harness to the input-side or the output-side connectors 21, 22 possible.

In order to minimize the number of components needed for the connector assembly 3, the input terminal block 201 and the output terminal block 202 are identical in design. They are arranged in mirror symmetry. In this way, the input side E and the output side A are arranged in the extension direction 53 on opposite sides of the connector assembly 3.

The electrical connection of the input-side connectors 21 with the output-side connectors 22 is also performed by a connecting kit 1, which is designed similar to the embodiments described in FIG. 1.

Also in this embodiment of the connector assembly 3 the two terminal blocks 201, 202 are formed each time from a plurality of series terminals 20 placed in a row in the arrangement direction 52. Furthermore, the connecting kit 1 is also formed from a plurality of row caps 10 lined up in a row in the arrangement direction 52. The number of connectors 21, 22, 23 is therefore also adaptable by using more or fewer series terminals 20 and row caps 10.

However, not every series terminal 20 here includes the locking devices 251, 252 for locking on the support rail. Instead, the series terminals 20 are arranged on a support 31 designed as a strip. On the support 31 there are arranged locking devices 351, 352 for locking on the support rail.

FIG. 2(*a*) shows a perspective representation of the connector assembly, FIG. 2(*b*) a cross section through the connector assembly, FIG. 2(*c*) an exploded representation of the connector assembly in a perspective view and FIG. 2(*d*) an exploded representation of the connector assembly without the support in another perspective view.

The terminal location K is shown in FIGS. 2(*c*) and (*d*). The connectors 23 are designed as plug units in FIG. 2(*c*), and the mating connectors 11 are designed as sockets in FIG. 2(*d*).

The embodiment of FIG. 3 of the connector assembly 3 also includes an input terminal block 201 and an output terminal block 202. The input terminal block 201 and the output terminal block 202 are also identical in design in this embodiment. They are likewise arranged in mirror symmetry, so that the input side E and the output side A in the extension direction 53 are arranged on opposite sides of the connector assembly 3.

However, in this embodiment the connectors 23 are each arranged flush with their input-side or output-side connectors 21, 22. Furthermore, the input terminal block 201 and the output terminal block 202 are spaced apart from each other in the extension direction 53. The terminal location K is thereby arranged between the input terminal block 201 and the output terminal block 202.

Furthermore, the input terminal block 201 and the output terminal block 202 in this embodiment are arranged each time in a housing.

In FIG. 3(*a*), which shows a perspective view of the connector assembly 3, parts of the housing 341, 342 are left out, so that the terminal location K can be seen between the input terminal block 201 and the output terminal block 202.

In order to make the terminal location K for the electrical connection of the input-side connectors 21 with the output-side connectors 22 accessible to the user, the two housings 341, 342 can swivel relative to each other about a swivel axis 32 in a swivel direction 320.

FIG. 3(*b*) shows the connector assembly of this embodiment without the housing sections. FIGS. 3(*c*)-(*e*) show the connector assembly, the housing 342 of the output terminal block 202 being swiveled relative to the housing 341 of the input terminal block 201 by 180° in the swivel direction 320 about the swivel axis 32. In this way, the housings 341, 342 are open. The terminal location K is then accessible to a user from the outside.

In FIGS. 3(*c*) and (*e*) the terminal location K is shown with the connectors 23. In FIG. 3(*d*) the input side E with the input-side connectors 21 and the output side A with the output-side connectors 22 of the connector assembly 3 are shown.

In FIG. 3(*e*) a sample configuration of the configuration location K is shown. For the electrical connection of the input-side connectors 21 and the output-side connectors 22 to each other, electrical conductors 6 are provided. In the configuration shown, all electrical conductors 6 connect one input-side connector location 21 to one output-side connector location 22. Each time one connector 23 at the input side E connected to an input-side connector location 21 is electrically connected by an electrical conductor 6 to a configuration connector location 23 at the output side A connected to an output-side connector location 22. But a configuration is also conceivable where electrical conductors 6 only interconnect input-side connectors 21 or only output-side connectors 22. In this configuration, an electrical conductor 6 only interconnects configuration connectors 23 connected to input-side connectors 21, or only configuration connectors 23 connected to output-side connectors 22.

Also in FIG. 3(*f*), housing parts are left out from the housing 341, 342 of the connector assembly 3, so that the terminal location can be seen. FIG. 3(*f*) shows the final configured connector assembly 3 with housings 341, 342 closed.

FIG. 4 shows another embodiment of the connector assembly 3 with an input terminal block 201 and an output terminal block 202. The input terminal block 201 and the output terminal block 202 each include two two-row and four-column attachment plugs 28 alongside each other, whose connectors 21, 22 are designed as sockets. The number of connectors 21, 22 can be adapted by the number of attachment plugs 28 and/or the number of their rows R or columns S.

The attachment plugs of the input terminal block 201 and the output terminal block 202 are each arranged on a support 31. The support of this embodiment includes no locking devices for locking onto a support rail, but it is possible to provide them if desired.

The input terminal block 201 and the output terminal block 202 are spaced apart from each other. Between them is provided the terminal location K.

A connecting kit 1 is provided for the electrical connection of the input-side connectors 21 to the output-side connectors 22.

In the representation shown in FIG. 4(*a*), the connecting kit 1 is attached to the terminal location K.

The connecting kit 1 includes a cover 12 which can swivel about a swivel axis 33 in a swivel direction 330. The representation shows the connecting kit 1 with the cover 12 swiveled about the swivel axis 33. In this way, the interior 14 of the connecting kit 1 can be seen. In the interior is arranged the second terminal location K' with the connecting plug locations 13'.

FIG. 4(*b*) shows the connector assembly 3 with cover 12 closed. FIG. 4(*c*) shows the connector assembly 3 in an exploded representation, with the connecting kit 1 arranged above the terminal location K, in a perspective view from above. FIG. 4(*d*) shows the arrangement of FIG. 4 (*c*) in another perspective view from below. FIG. 4(*e*) shows the final configured connector assembly 3 in a representation similar to FIG. 4(*a*).

Since the connecting kit 1 in FIG. 4(*c*) is spaced apart from the terminal location K, the connectors 23 can be seen in this representation. The electrical connections, especially bus bars, of the input-side connectors 21 to the configuration connectors 23 and of the output-side connectors 22 to the connectors 23 are arranged in the support 31. The connectors 23 here are designed as sockets.

The mating connectors 11 corresponding to the connectors 23 are shown in FIG. 4(*d*).

Figure 5A:
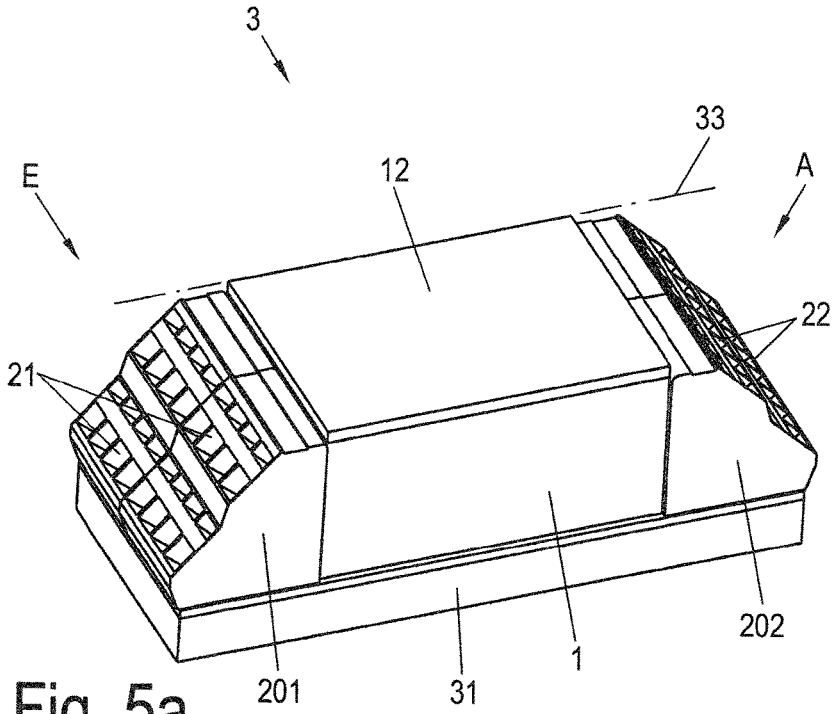
FIG. 5*a* is a top perspective view of a connector assembly according to a fifth embodiment of the invention.
Figure 5B:
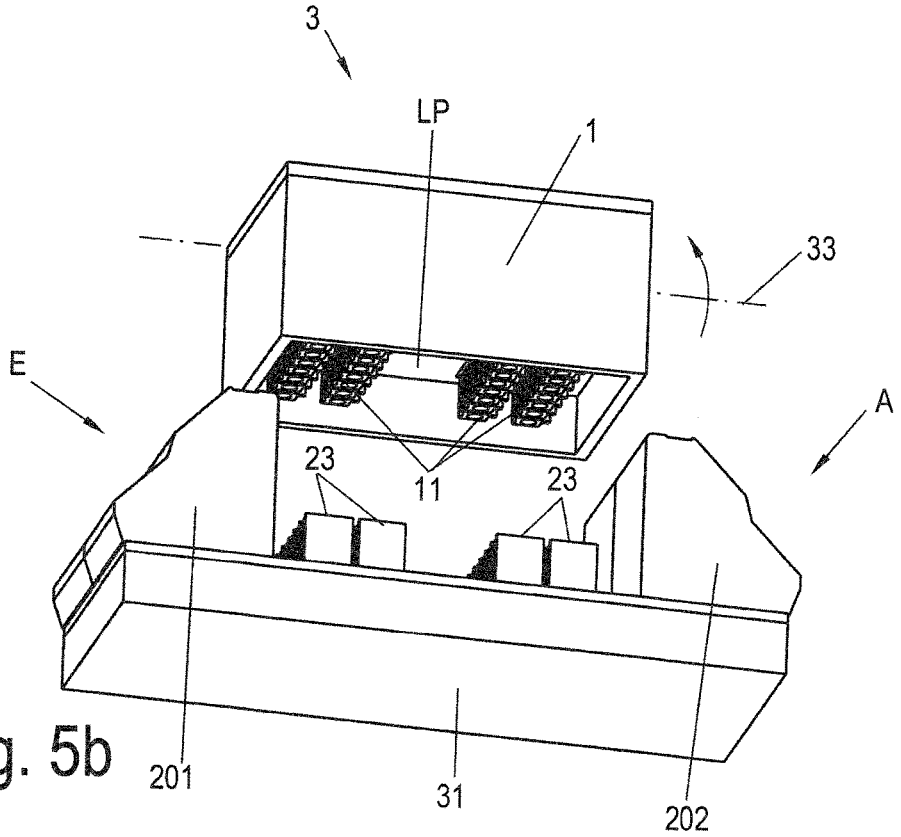
FIG. 5*b* is an exploded bottom view of the connector assembly of FIG. 5*a*.

The connector assembly 3 of FIG. 5 differs from that of FIG. 4 on the one hand by the smaller connecting kit 1. Here, the connectors 23 at the input side E and 23 at the output side A are provided. The electrical connections of the input-side connectors 21 to the connectors 23 and the output-side connectors 22 to the connectors 23 are arranged in the support 31. For this, wires, bus bars or at least one circuit board or a plurality of circuit boards with conductor tracks can be provided in the support 31 (also able to be pushed in or inserted in the support).

The connectors 23 are designed as plug and socket connectors (sockets or pins). The mating connectors 11 corresponding to the connectors 23 (plug and socket connectors corresponding to the plug and socket connectors 23, i.e., pins or sockets) can be seen in FIG. 5(*b*). For connecting the input and output-side plug and socket connectors 11 at the input side E and 11 at the output side A there is provided at least one circuit board LP. This circuit board can be fabricated and provided with conductor tracks corresponding to the occupancy of the input and output-side connectors 21, 22, for example with the aid of an appropriate circuit board layout configuring system, which has a corresponding circuit board layout configuring program in which the occupancy of the connectors 21 and 22 is put in as data. This makes a manual connection with wires or jumpers, e.g., longitudinal connectors and cross connectors rotated by 90° relative to them unnecessary. Plug and socket connections can be provided on the circuit board, which are attached to corresponding plug and socket connector sides on the plug and socket connectors (not shown).

In place of a circuit board, or on a circuit board designed for this, it is also possible to provide actuatable electronics in the top part mount or directly in the base 31 (which then remains with no top part), having conductor tracks (of the same or different cross section) and switching elements such as relays or transistors, connecting or not connecting the tracks in a controlled manner according to the actuation, by which the connection between the input-side connectors 21 and the output-side connectors 22 or the connectors 11 at the output side A and 11 at the input side E is electronically realized. Functions such as voltage surge protection fuses or the like can also be provided.

The invention claimed is:

1. An electrical connector assembly for a medium voltage switchgear, comprising (a) a first housing including an input terminal block and a second housing including an output terminal block, said first and second housings being pivotally connected for rotation about an axis between open and closed positions;

(b) a plurality of input terminal connectors arranged on an exterior surface of said input terminal block;

(c) a plurality of output terminal connectors arranged on and exterior surface of said output terminal block, said output terminal connectors being electrically independent of said input terminal connectors; and (d) a plurality of input configurable connectors connected with said input terminal connectors, respectively, and a plurality of output configurable connectors connected with said output terminal connectors, respectively, said input and output configurable connectors being arranged between and within said first and second housings and spaced from each other to define a terminal location within said first and second housings when said first and second housings are in said closed position.

2. The electrical connector assembly as defined in claim 1, wherein said input configurable connectors are arranged flush with said input connectors and said output configurable connectors are arranged flush with said output connectors.

3. The electrical connector assembly as defined in claim 1, wherein said input terminal block and said output terminal block are identical.

4. The electrical connector assembly as defined in claim 1, wherein said input terminal connectors, output terminal connectors and configurable connectors comprise one of plug and socket connectors.

5. The electrical connector assembly as defined in claim 4, and further comprising at least one electrical conductor arranged in said terminal location and connected with and between a selected input configurable connector and an output configurable connector to provide an electrical connection for said connector assembly between an input connector and an output connector.

6. The electrical connector assembly as defined in claim 5, wherein said electrical conductor comprises a wire.

7. The electrical connector assembly as defined in claim 1, wherein input and output terminal blocks each include a locking device on a side of said first and second housings opposite a pivotal connection between said input and output terminal blocks for connecting said first and second housings with a support and retaining said input and output terminal blocks in said closed position.

* * * * *